US012098519B2

(12) United States Patent
Matsumoto et al.

(10) Patent No.: US 12,098,519 B2
(45) Date of Patent: Sep. 24, 2024

(54) SYSTEM AND CONTROL METHOD FOR PREVENTING ERRONEOUS OPERATION OF WORK MACHINE, AND EXCAVATOR

(71) Applicant: KOMATSU LTD., Tokyo (JP)

(72) Inventors: Jun Matsumoto, Tokyo (JP); Yuuki Kobayashi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 239 days.

(21) Appl. No.: 17/781,481

(22) PCT Filed: Jan. 7, 2021

(86) PCT No.: PCT/JP2021/000335
§ 371 (c)(1),
(2) Date: Jun. 1, 2022

(87) PCT Pub. No.: WO2021/153182
PCT Pub. Date: Aug. 5, 2021

(65) Prior Publication Data

US 2023/0018377 A1 Jan. 19, 2023

(30) Foreign Application Priority Data

Jan. 31, 2020 (JP) ..... 2020-015440

(51) Int. Cl.
*E02F 9/20* (2006.01)
*E02F 3/32* (2006.01)
(Continued)

(52) U.S. Cl.
CPC ..... *E02F 9/2012* (2013.01); *E02F 9/24* (2013.01); *E02F 9/26* (2013.01); *E02F 3/32* (2013.01)

(58) Field of Classification Search
CPC ... E02F 9/2012; E02F 9/24; E02F 9/26; E02F 3/32
(Continued)

(56) References Cited

U.S. PATENT DOCUMENTS 9,363,441 B2 * 6/2016 Crookham ..... H04N 23/69
2008/0127531 A1 * 6/2008 Stanek ..... E02F 9/2004 701/50
(Continued)

FOREIGN PATENT DOCUMENTS

CN 101815630 A 8/2010
CN 106170414 A 11/2016
(Continued)

OTHER PUBLICATIONS

The Office Action for the corresponding Chinese application No. 202180006632.7, issued on May 27, 2023.
(Continued)

*Primary Examiner* — Atul Trivedi
(74) *Attorney, Agent, or Firm* — Global IP Counselors, LLP

(57) ABSTRACT

A camera captures an image of a region including at least a portion of an operating member and generates image data indicative of the image. A controller acquires the image data from the camera. The controller determines whether an operation of the operating member by an operator is an intentional operation or an unintentional operation based on the image. When the operation of the operating member by the operator is determined to be the intentional operation, the controller controls a work machine according to the operation of the operating member. When the operation of the operating member by the operator is determined to be the unintentional operation, the controller invalidates the operation of the operating member.

17 Claims, 16 Drawing Sheets

(51) Int. Cl.
*E02F 9/24* (2006.01)
*E02F 9/26* (2006.01)

(58) Field of Classification Search
USPC ..... 701/34.4
See application file for complete search history.

(56) References Cited

U.S. PATENT DOCUMENTS

| | | | | |
|---|---|---|---|---|
| 2008/0133094 | A1* | 6/2008 | Stanek | E02F 9/2041 37/468 |
| 2010/0217492 | A1* | 8/2010 | Kodaka | F16H 61/4061 701/50 |
| 2015/0004566 | A1* | 1/2015 | Bomer | G09B 19/167 434/62 |
| 2015/0153733 | A1* | 6/2015 | Ohmura | G05D 1/0295 701/23 |
| 2017/0107693 | A1 | 4/2017 | Yamada | |
| 2017/0275848 | A1* | 9/2017 | Marquette | E02F 9/265 |
| 2017/0305018 | A1* | 10/2017 | Machida | B25J 9/1674 |
| 2018/0134262 | A1* | 5/2018 | Kurahashi | B60W 50/12 |
| 2020/0032482 | A1* | 1/2020 | Meguriya | E02F 9/2033 |
| 2020/0032489 | A1* | 1/2020 | Yamazaki | G05D 1/021 |
| 2020/0173143 | A1 | 6/2020 | Kurokawa et al. | |
| 2020/0173148 | A1* | 6/2020 | Nishi | E02F 9/26 |
| 2021/0002860 | A1* | 1/2021 | Otani | H04N 7/183 |
| 2023/0134855 | A1* | 5/2023 | Hodel | E02F 9/205 701/50 |
| 2023/0183942 | A1* | 6/2023 | Tamura | E02F 9/26 715/771 |
| 2023/0279638 | A1* | 9/2023 | Danguchi | E02F 9/24 701/50 |
| 2023/0279645 | A1* | 9/2023 | Danguchi | E02F 9/261 |

FOREIGN PATENT DOCUMENTS

| | | | | | |
|---|---|---|---|---|---|
| CN | 207277400 | U | * | 4/2018 | |
| CN | 113727883 | A | * | 11/2021 | B60K 35/00 |
| CN | 113728141 | A | * | 11/2021 | B60R 1/00 |
| CN | 113748247 | A | * | 12/2021 | E02F 3/32 |
| CN | 113767202 | A | * | 12/2021 | E02F 3/32 |
| EP | 2624552 | A1 | * | 8/2013 | E02F 9/261 |
| EP | 3333831 | A1 | * | 6/2018 | G09B 19/16 |
| EP | 3575501 | A1 | * | 12/2019 | B62D 1/22 |
| JP | 2004-19127 | A | | 1/2004 | |
| JP | 2007-72629 | A | | 3/2007 | |
| JP | 2010-250459 | A | | 11/2010 | |
| JP | 2015-108860 | A | | 6/2015 | |
| JP | 2018-79707 | A | | 5/2018 | |
| JP | 2019-176401 | A | | 10/2019 | |
| KR | 10-2008-0006950 | A | | 1/2008 | |
| KR | 10-2015-0067926 | A | | 6/2015 | |
| WO | 2019/039522 | A1 | | 2/2019 | |
| WO | WO-2019155843 | A1 | * | 8/2019 | E02F 3/32 |
| WO | WO-2019189589 | A1 | * | 10/2019 | E02F 3/435 |
| WO | WO-2020003994 | A1 | * | 1/2020 | E02F 3/43 |

OTHER PUBLICATIONS

Tongzhu Liu, "Construction Mode and Innovation of Intelligent Hospital", Publishing Company of China Science and Technology University; Dec. 2019.

The International Search Report for the corresponding international application No. PCT/JP2021/000335, issued on Mar. 30, 2021.

The Office Action for the corresponding Chinese application No. 202180006632.7, issued on Jan. 13, 2023.

The Office Action for the corresponding Korean application No. 10-2022-7016081, issued on Nov. 20, 2023.

* cited by examiner

SYSTEM AND CONTROL METHOD FOR PREVENTING ERRONEOUS OPERATION OF WORK MACHINE, AND EXCAVATOR

CROSS-REFERENCE TO RELATED APPLICATIONS

This application is a U.S. National stage application of International Application No. PCT/JP2021/000335, filed on Jan. 7, 2021. This U.S. National stage application claims priority under 35 U.S.C. § 119(a) to Japanese Patent Application No. 2020-015440, filed in Japan on Jan. 31, 2020, the entire contents of which are hereby incorporated herein by reference.

The present invention relates to a system and a control method for preventing an erroneous operation of a work machine, and an excavator.

BACKGROUND INFORMATION

Generally, a work machine is provided with an operating member, such as a lever, for an operator to operate the work machine. For example, an operator operates the operating member by holding it with his or her hand. However, when the operator performs an operation other than the operation of the work machine, the operator's body or clothes may accidentally touch the operating member. In that case, the work machine operates an operation that is contrary to an intention of the operator.

In order to prevent an erroneous operation as described above, for example, Japanese Unexamined Patent Publication No. 2010-250459 discloses an erroneous operation prevention device. In this erroneous operation prevention device, a tactile sensor is mounted on the entire surface of the grip of the operation lever. When the pressure detected by the tactile sensor continues for a predetermined time, a controller determines that the holding of the operating lever has been detected and releases a hydraulic locking mechanism.

SUMMARY

A way of operating the operating member (for example, a way of holding or touching) varies depending on an operator. Therefore, in the above-mentioned erroneous operation prevention device, the tactile sensor may not accurately detect the holding by the operator. Also, in the above-mentioned erroneous operation prevention device, the controller determines whether the pressure detected by the tactile sensor has continued for a predetermined time. Therefore, it takes time to release the hydraulic locking mechanism. As a result, the operability of the work machine during normal operation is deteriorated.

An object of the present disclosure is to detect an erroneous operation of a work machine with high accuracy.

A system according to one aspect of the present disclosure is a system for preventing an erroneous operation of a work machine. The system includes an operating member, a camera, and a controller. The operating member is operable by an operator. The camera captures an image of a region including at least a portion of the operating member and generates image data indicative of the image. The controller acquires the image data from the camera. The controller determines whether an operation of the operating member by the operator is an intentional operation or an unintentional operation based on the image. When the operation of the operating member by the operator is the intentional operation, the controller controls the work machine according to the operation of the operating member. When the operation of the operating member by the operator is the unintentional operation, the controller invalidates the operation of the operating member.

A method according to another aspect of the present disclosure is a control method for preventing an erroneous operation of a work machine. The control method includes the following processes. A first process is to acquire image data indicative of an image of a region including at least a portion of an operating member. A second process is to determine whether an operation of the operating member by an operator is an intentional operation or an unintentional operation based on the image. A third process is to control the work machine according to the operation of the operating member when the operation of the operating member by the operator is the intentional operation. A fourth process is to invalidate the operation of the operating member when the operation of the operating member by the operator is the unintentional operation.

An excavator according to another aspect of the present disclosure includes a traveling body, a rotating body, a work implement, a cab, an operating member, a camera, and a controller. The rotating body is rotatably attached to the traveling body. The work implement is attached to the rotating body. The cab is disposed on the rotating body. The operating member is disposed in the cab. The operating member is operable by an operator in order to operate at least one of the traveling body, the rotating body, or the work implement. The camera captures an image of a region including at least a portion of the operating member. The camera generates image data indicative of the image. The controller acquires the image data from the camera. The controller determines whether an operation of the operating member by the operator is an intentional operation or an unintentional operation based on the image. When the operation of the operating member by the operator is the intentional operation, the controller controls at least one operation of the traveling body, the rotating body, or the work implement according to the operation of the operating member. When the operation of the operating member by the operator is the unintentional operation, the controller invalidates the operation of the operating member.

According to the present disclosure, it is determined whether the operation of the operating member by the operator is the intentional operation or the unintentional operation based on the image of the region including at least a portion of the operating member. Therefore, it is possible to detect an erroneous operation with high accuracy regardless of a way of operating by each operator. Further, it is possible to quickly determine whether the operation of the operating member by the operator is a normal operation. Therefore, the deterioration of the operability of the work machine during normal operation can be reduced.

DESCRIPTION OF EMBODIMENTS

Figure 1:
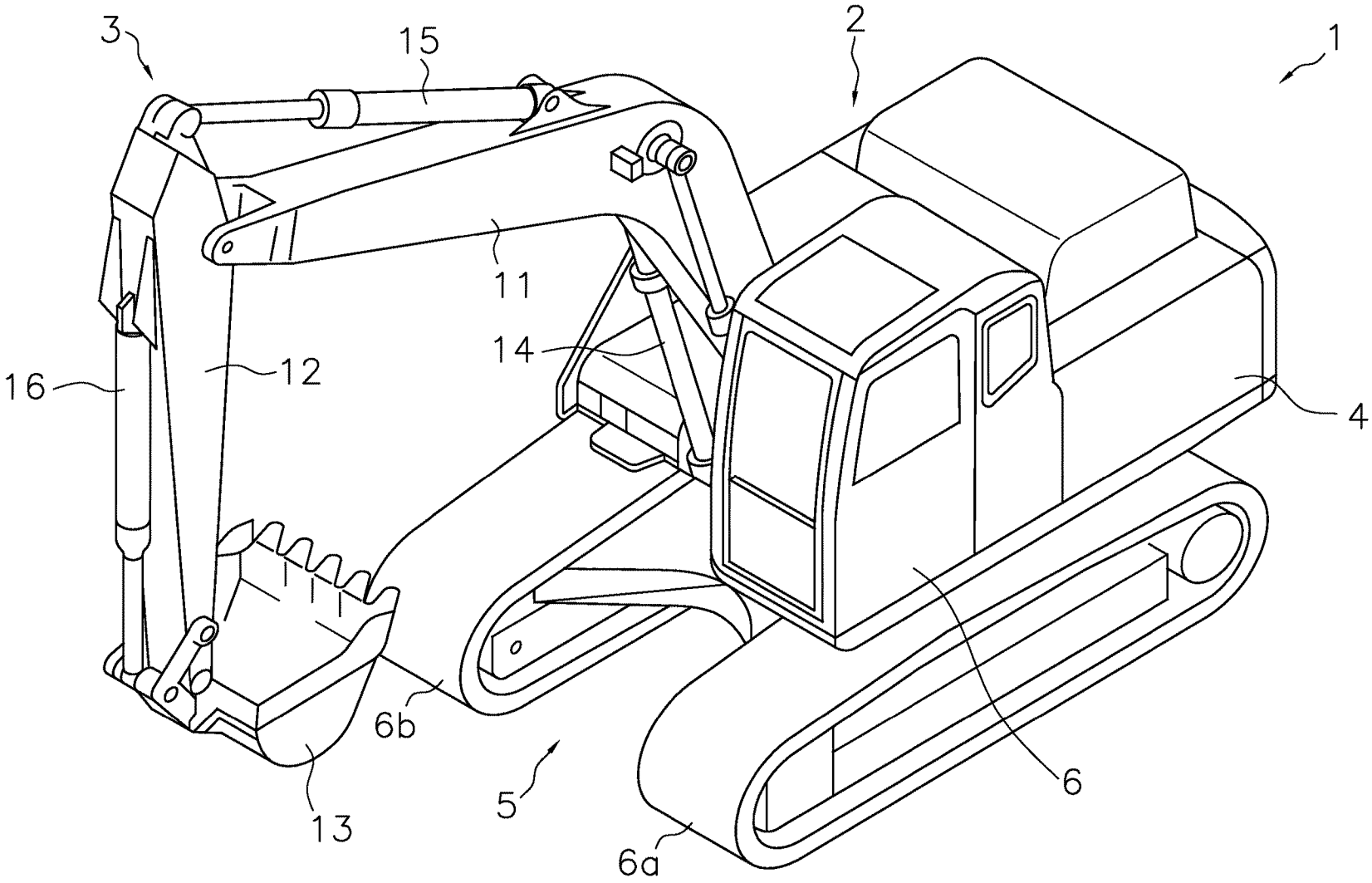
FIG. 1 is a side view of a work machine.

Hereinafter, a control system of a work machine 1 according to an embodiment will be described with reference to the drawings. FIG. 1 is a side view of the work machine 1. In the present embodiment, the work machine 1 is a hydraulic excavator.

As illustrated in FIG. 1, the work machine 1 includes a vehicle body 2 and a work implement 3. The work implement 3 is attached to the front part of the vehicle body 2. The vehicle body 2 includes a rotating body 4, a traveling body 5, and a cab 6. The rotating body 4 is rotatably attached to the traveling body 5. The cab 6 is disposed on the rotating body 4. The traveling body 5 includes crawler belts 6*a* and 6*b*. The work machine 1 travels due to the rotation of the crawler belts 6*a* and 6*b*.

The work implement 3 includes a boom 11, an arm 12, and a bucket 13. The boom 11 is attached to the rotating body 4 so as to be movable up and down. The arm 12 is movably attached to the boom 11. The bucket 13 is movably attached to the arm 12. The work implement 3 includes a boom cylinder 14, an arm cylinder 15, and a bucket cylinder 16. The boom cylinder 14, the arm cylinder 15, and the bucket cylinder 16 are hydraulic cylinders and driven by hydraulic fluid supplied from a hydraulic pump 22 described later. The boom cylinder 14 actuates the boom 11. The arm cylinder 15 actuates the arm 12. The bucket cylinder 16 actuates the bucket 13.

Figure 2:
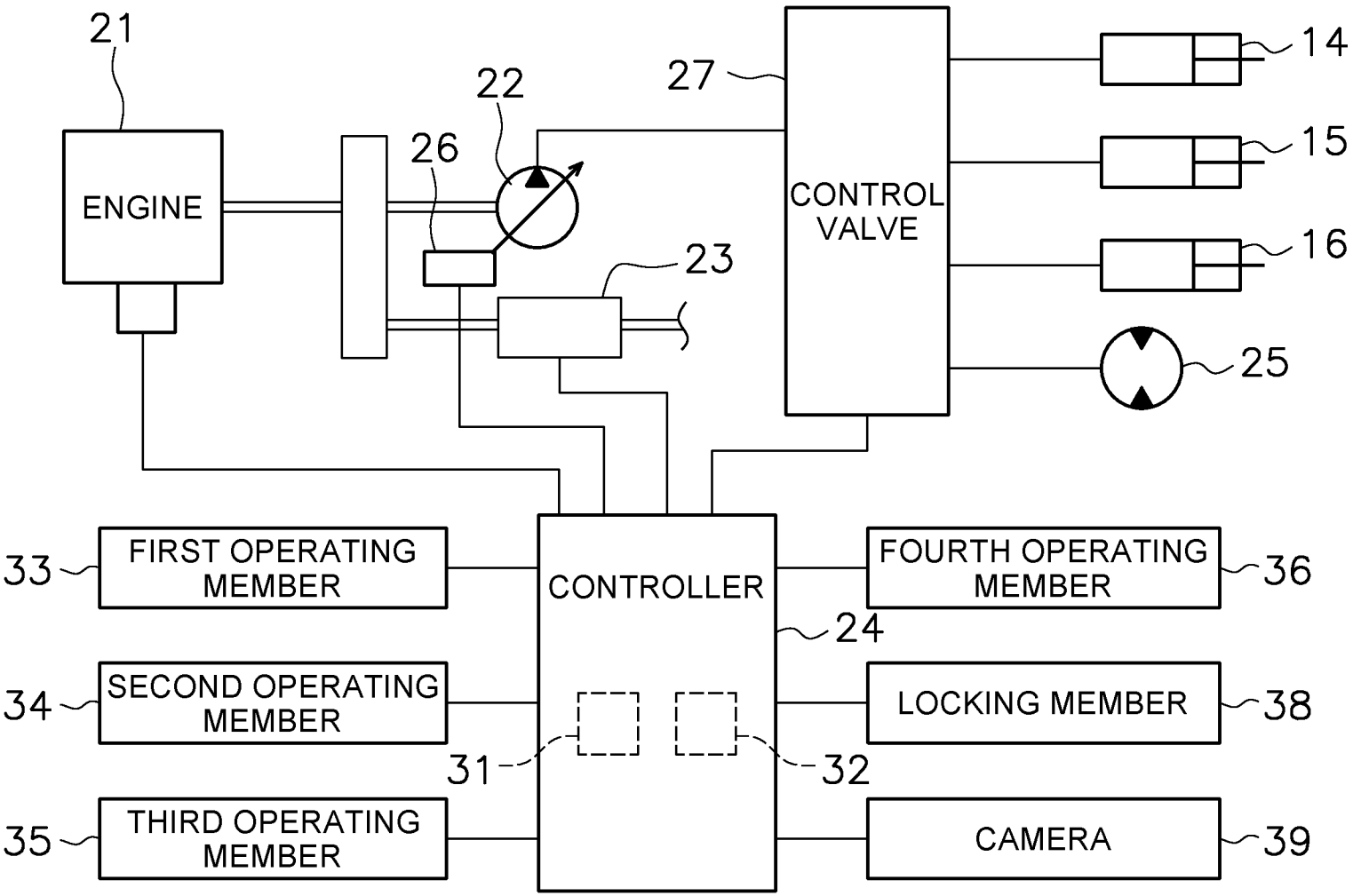
FIG. 2 is a block diagram illustrating a configuration of a control system of the work machine.

FIG. 2 is a block diagram illustrating a configuration of a control system of the work machine 1. As illustrated in FIG. 2, the work machine 1 includes an engine 21, a hydraulic pump 22, a power transmission device 23, and a controller 24. The engine 21 is controlled by command signals from the controller 24. The hydraulic pump 22 is driven by the engine 21 to discharge hydraulic fluid. The hydraulic fluid discharged from the hydraulic pump 22 is supplied to the boom cylinder 14, the arm cylinder 15, and the bucket cylinder 16.

The work machine 1 includes a rotation motor 25. The rotation motor 25 is a hydraulic motor and driven by hydraulic fluid from the hydraulic pump 22. The rotation motor 25 causes the rotating body 4 to rotate. Although one hydraulic pump 22 is illustrated in FIG. 2, a plurality of hydraulic pumps may be included.

The hydraulic pump 22 is a variable displacement pump. A pump control device 26 is connected to the hydraulic pump 22. The pump control device 26 controls the tilt angle of the hydraulic pump 22. The pump control device 26 includes, for example, an electromagnetic valve and is controlled by command signals from the controller 24. The controller 24 controls the pump control device 26, thereby controlling the displacement of the hydraulic pump 22.

The work machine 1 includes a control valve 27. The hydraulic pump 22, the cylinders 14 to 16, and the rotation motor 25 are connected to each other by means of a hydraulic circuit via the control valve 27. The control valve 27 is controlled by command signals from the controller 24. The control valve 27 controls the flow rate of the hydraulic fluid supplied from the hydraulic pump 22 to the cylinders 14 to 16 and the rotation motor 25. The controller 24 controls the control valve 27, thereby controlling the operation of the work implement 3. The controller 24 controls the control valve 27, thereby controlling the rotation of the rotating body 4.

The power transmission device 23 transmits driving force of the engine 21 to the traveling body 5. The crawler belts 6*a* and 6*b* are driven by the driving force from the power transmission device 23 to cause the work machine 1 to travel. The power transmission device 23 may be, for example, a torque converter or a transmission having a plurality of transmission gears. Alternatively, the power transmission device 23 may be another type of transmission, such as a hydro static transmission (HST) or a hydraulic mechanical transmission (HMT).

The controller 24 is programmed to control the work machine 1 based on acquired data. The controller 24 controls the engine 21, the traveling body 5, and the power transmission device 23, thereby causing the work machine 1 to travel. The controller 24 controls the hydraulic pump 22 and the control valve 27, thereby causing the work implement 3 to operate. The controller 24 controls the hydraulic pump 22 and the control valve 27, thereby causing the rotating body 4 to rotate.

The controller 24 includes a processor 31, such as a CPU. The processor 31 executes processes for controlling the work machine 1. The controller 24 includes a storage device 32. The storage device 32 includes a memory, such as a RAM or a ROM, and an auxiliary storage device, such as a hard disk drive (HDD) or a solid state drive (SSD). The storage device 32 stores data and programs for controlling the work machine 1.

Figure 3:
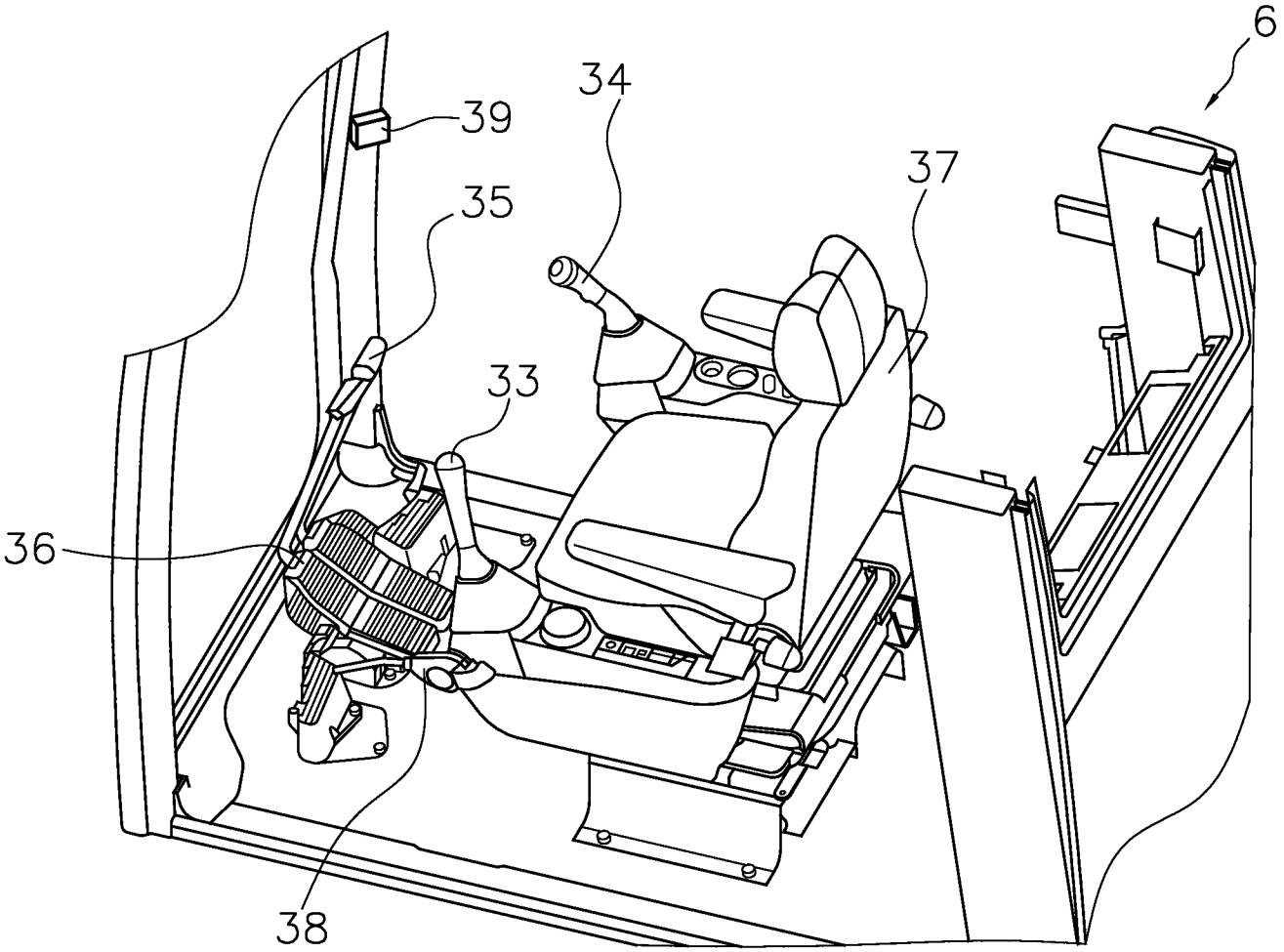
FIG. 3 is a perspective view illustrating an inside of a cab.

The work machine 1 includes a first operating member 33, a second operating member 34, a third operating member 35, and a fourth operating member 36. FIG. 3 is a perspective view illustrating an inside of the cab 6. As illustrated in FIG. 3, the first operating member 33, the second operating member 34, the third operating member 35, and the fourth operating member 36 are disposed in the cab 6. A seat 37 is disposed in the cab 6. The first operating member 33 is disposed at one side of the seat 37. The second operating member 34 is disposed at the other side of the seat 37. The first operating member 33 and the second operating member 34 are operated by a hand of an operator.

The first operating member 33 is a lever. The first operating member 33 is tiltable in the front-back and left-right directions from a neutral position. The first operating member 33 outputs a signal indicative of the operating direction and operating amount of the first operating member 33. The controller 24 receives the signal from the first operating member 33. The controller 24 causes the work implement 3 to operate according to the operation of the first operating member 33 by the operator. Alternatively, the controller 24 causes the rotating body 4 to rotate according to the operation of the first operating member 33 by the operator.

The second operating member 34 is a lever. The second operating member 34 is tiltable in front-back and left-right directions from a neutral position. The second operating member 34 outputs a signal indicative of the operating direction and operating amount of the second operating member 34. The controller 24 receives the signal from the second operating member 34. The controller 24 causes the work implement 3 to operate according to the operation of the second operating member 34 by the operator.

The third operating member 35 is disposed in front of the seat 37. The third operating member 35 is a lever. The third operating member 35 is tiltable in the front-back direction. The third operating member 35 outputs a signal indicative of the operating direction and operating amount of the third operating member 35. The controller 24 receives the signal from the third operating member 35. The controller 24 causes the work machine 1 to travel according to the operation of the third operating member 35 by the operator.

The fourth operating member 36 is a pedal. The fourth operating member 36 is coupled to the third operating member 35. The fourth operating member 36 operates integrally with the third operating member 35. The controller 24 causes the work machine 1 to travel according to the operation of the third operating member 35 or the fourth operating member 36 by the operator.

The work machine 1 includes a locking member 38. The locking member 38 is disposed in the cab 6. The locking member 38 is disposed at a side of the seat 37. The locking member 38 is movable between a locked position and a released position. When the locking member 38 is in the locked position, the controller 24 invalidates the operation of the first operating member 33 and the second operating member 34. That is, when the locking member 38 is in the locked position, the controller 24 prohibits the operation of the work implement 3 regardless of the operation of the first operating member 33 and the second operating member 34. When the locking member 38 is in the locked position, the controller 24 prohibits the rotation of the rotating body 4 regardless of the operation of the first operating member 33.

For example, in a case where the control valve 27 is an electric pilot type, the controller 24 does not output a command signal to the control valve 27 regardless of the operation of the first operating member 33 and the second operating member 34 when the locking member 38 is in the locked position. Alternatively, in a case where the control valve 27 is a hydraulic pilot type, the controller 24 stops supplying the pilot pressure to the control valve 27 when the locking member 38 is in the locked position.

When the locking member 38 is in the released position, the controller 24 controls the work implement 3 or the rotating body 4 according to the operation of the first operating member 33 and the second operating member 34. That is, when the locking member 38 is in the released position, the controller 24 causes the work implement 3 to operate according to the operation of the first operating member 33 and the second operating member 34. When the locking member 38 is in the released position, the controller 24 causes the rotating body 4 to rotate according to the operation of the first operating member 33.

The work machine 1 includes a camera 39. The camera 39 captures an image of a region including the first operating member 33, the second operating member 34, and the seat 37 in the cab 6. The number of cameras 39 is not limited to one and a plurality of cameras may be disposed in the cab 6. The camera 39 generates image data indicative of the captured image. The camera 39 communicates with the controller 24 by wire or wirelessly. The controller 24 receives the image data from the camera 39. The image indicated by the image data may be a still image or a moving image.

The controller 24 detects an erroneous operation of the first operating member 33 and the second operating member 34 by the operator based on the image. Hereinafter, processes for detecting an erroneous operation executed by the controller 24 will be described. In the following description, a case where the first operating member 33 is operated will be described. However, the same processes may be executed in a case where the second operating member 34 is operated.

Figure 4:
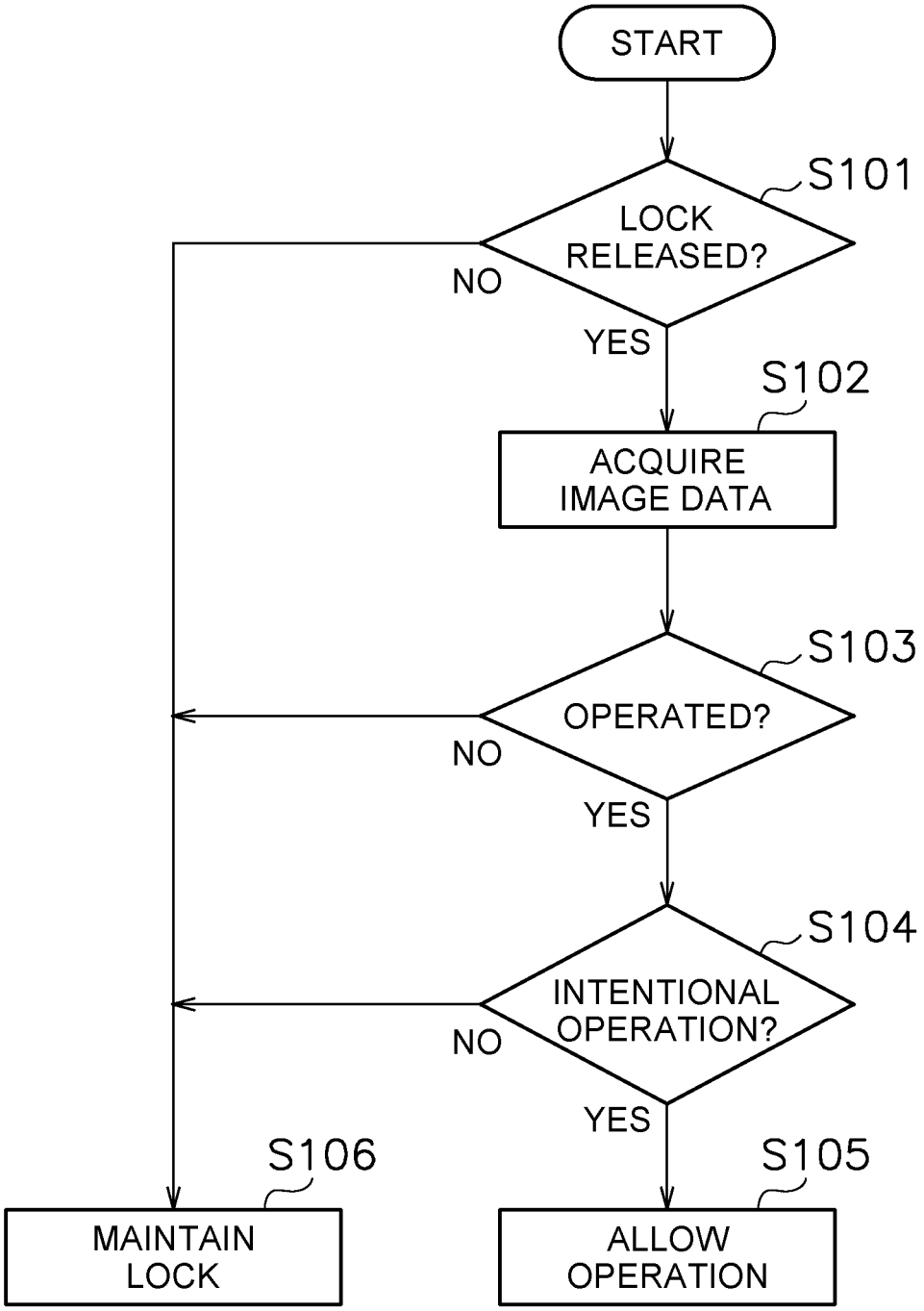
FIG. 4 is a flowchart illustrating processes for detecting an erroneous operation.

FIG. 4 is a flowchart illustrating processes for detecting an erroneous operation. In step S101, the controller 24 determines whether the lock is released. When the locking member 38 is in the locked position, the controller 24 determines that the lock is not released. When the lock is not released, the controller 24 maintains the lock in step S106. When the locking member 38 is in the released position, the controller 24 determines that the lock is released. When the lock is released, the process proceeds to step S102.

In step S102, the controller 24 acquires the image data. The controller 24 acquires the image data indicative of an image including the first operating member 33 from the camera 39.

In step S103, the controller 24 determines whether the operation of the first operating member 33 is performed. The controller 24 determines whether the operation of the first operating member 33 is performed based on a signal from the first operating member 33. When the operation of the first operating member 33 is not performed, the lock is maintained in step S106. When the operation of the first operating member 33 is performed, the process proceeds to step S104.

In step S104, the controller 24 determines whether the operation of the first operating member 33 by the operator is an intentional operation or an unintentional operation. The controller 24 performs a determination based on the image indicated by the image data.

Figure 5:
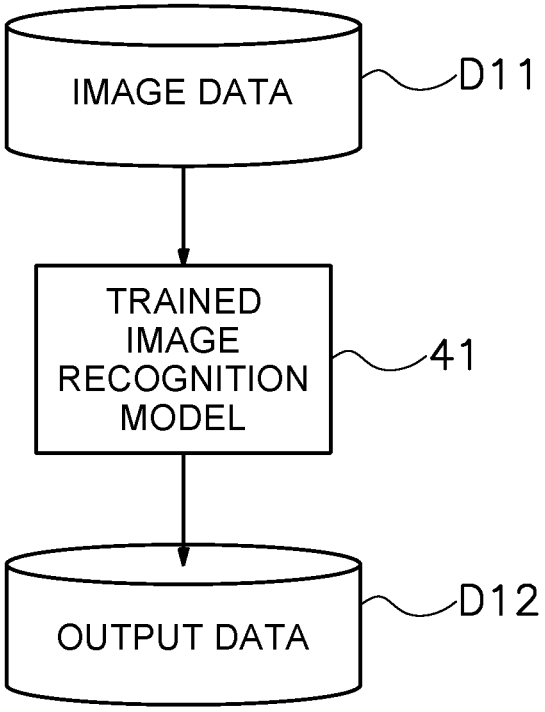
FIG. 5 is a diagram illustrating a configuration of an image recognition model of artificial intelligence.

The controller 24 determines whether the operation shown in the image is an intentional operation or an unintentional operation by using image recognition technology that uses artificial intelligence (AI). As illustrated in FIG. 5, the controller 24 includes an image recognition model 41 that is trained. The image recognition model 41 is implemented on the controller 24. The image recognition model 41 is an artificial intelligence model for image analysis. The image recognition model 41 analyzes image data D11 that is input and determines whether an image showing a specific operation is included in the images indicated by the image data D11.

Figure 6:
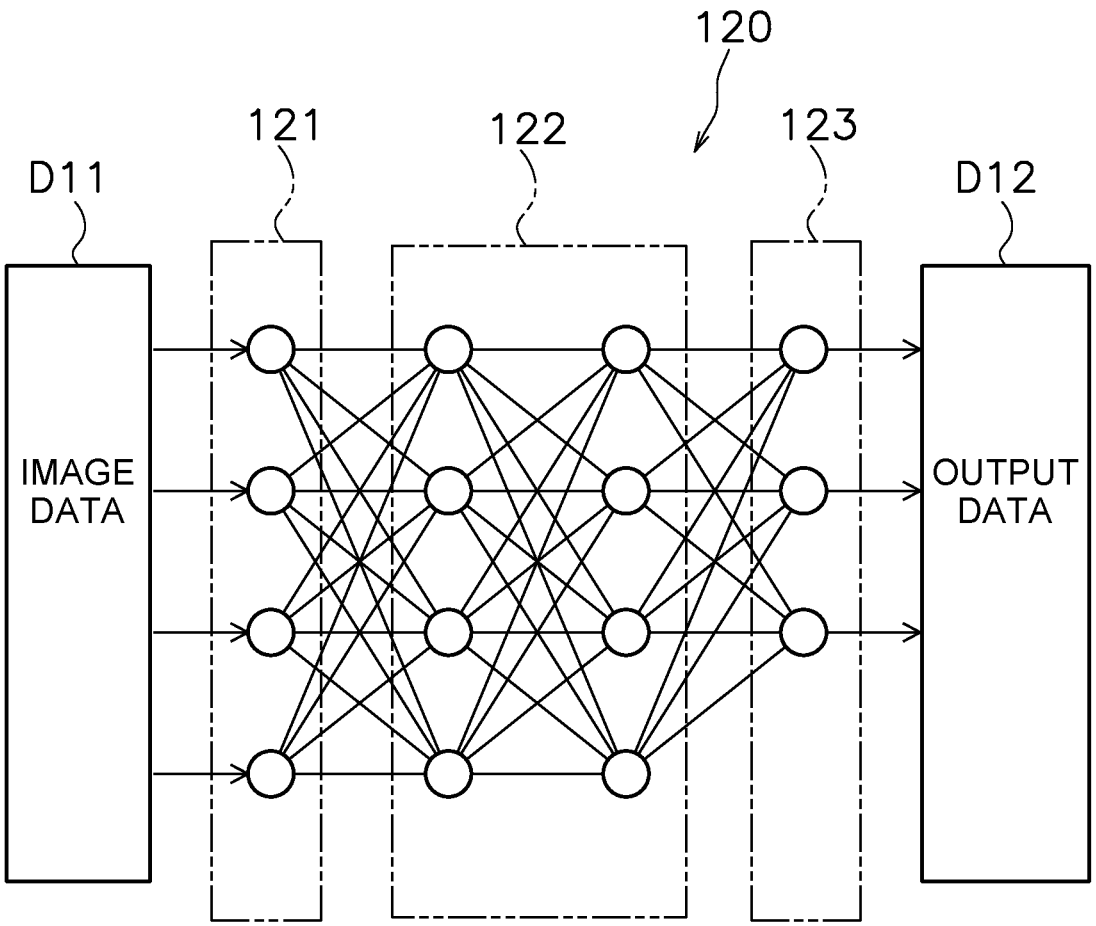
FIG. 6 is a diagram illustrating a configuration of the image recognition model of artificial intelligence.

The image recognition model 41 performs image analysis using deep learning. The image recognition model 41 includes a neural network illustrated in FIG. 6. For example, the image recognition model 41 includes a deep neural network, such as a convolutional neural network (CNN). As illustrated in FIG. 6, a neural network 120 includes an input layer 121, an intermediate layer 122, and an output layer 123. The layers 121, 122 and 123 include one or more neurons. The neurons of adjacent layers are coupled together and weights are set for each coupling. The number of neuron couplings may be set as appropriate. Threshold are set for each neuron and output data D12 of each neuron is determined according to whether the sum of the products of the input values to each neuron and the weights exceed the threshold.

The image data D11 is input to the input layer 121. The output data D12 indicative of a classification of the operation detected in the image is output to the output layer 123. The classification includes an intentional operation and an unintentional operation. The image recognition model 41 is trained to output the output data D12 indicative of the classification of the operation detected in the image when the image data D11 is input. Trained parameters of the image recognition model 41 acquired by training are stored in the controller 24. The trained parameters include, for example, the number of layers of the neural network, the number of neurons in each layer, the coupling relationships among the neurons, the weights of the couplings among neurons, and the thresholds of each neuron.

Figure 7:
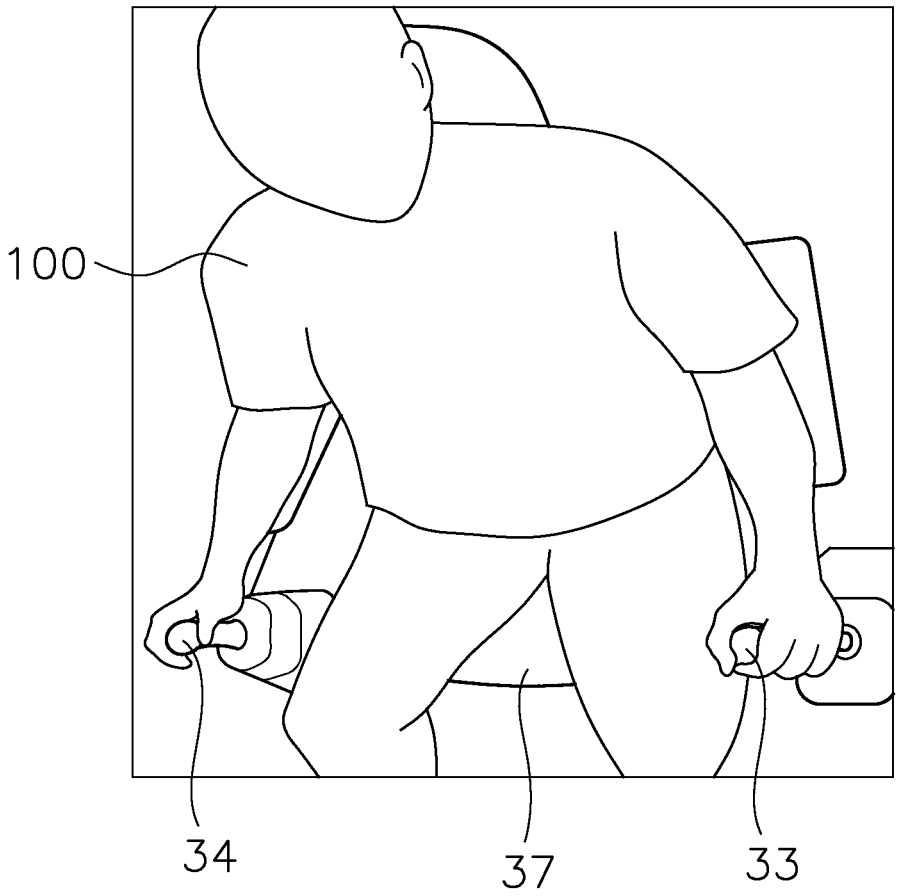
FIG. 7 is a view illustrating an example of an image of an operating state in which a first operating member is held.

For the image showing that the first operating member 33 is held by a hand of an operator 100 as illustrated in FIG. 7, the image recognition model 41 is trained to output the output data D12 indicative of the intentional operation. Therefore, when the image captured by the camera 39 shows that the first operating member 33 is held by the hand of the operator 100, the image recognition model 41 outputs the output data D12 indicative of the intentional operation. In this case, the controller 24 determines that the operation by the operator 100 is the intentional operation.

Figure 8D:
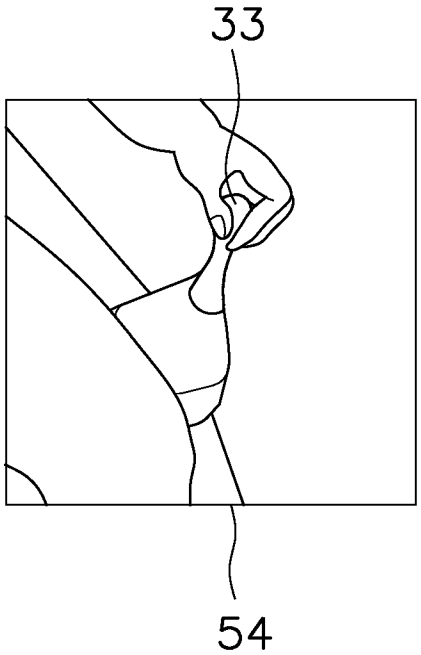
FIGS. 8A-8D are views illustrating examples of images of various ways the first operating member is held in the operating state.
Figure 8C:
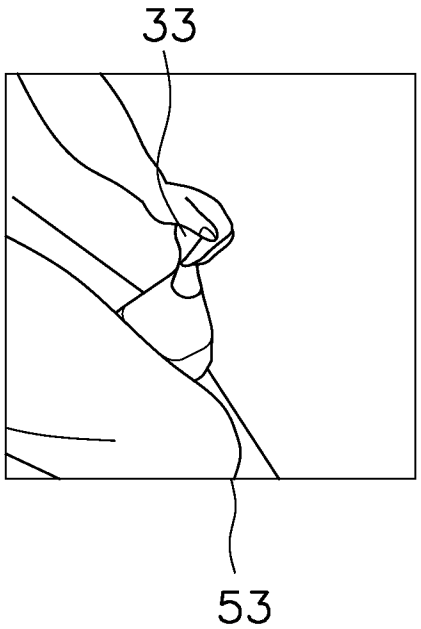
Figure 8B:
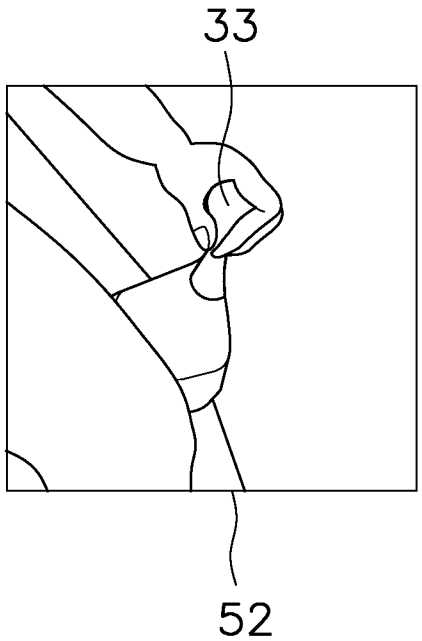
Figure 8A:
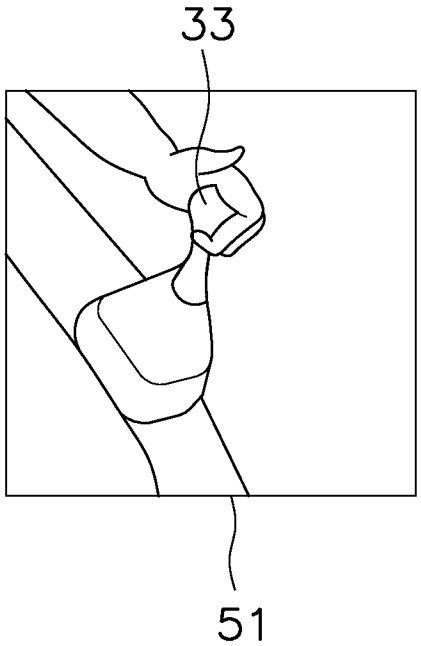

For the images of various ways of holding the first operating member 33 by the operator 100 as illustrated in FIGS. 8A-8D, the image recognition model 41 is trained to output the output data D12 indicative of the intentional operation. For example, an image 51 in FIG. 8A shows a state in which the first operating member 33 is held by some fingers with the other fingers untouched. An image 52 in FIG. 8B shows a state in which the first operating member 33 is held by the entire hand. An image 53 in FIG. 8C shows a state in which the first operating member 33 is pushed by a palm. An image 54 in FIG. 8D shows a state in which the first operating member 33 is touched by finger tips. Therefore, while the image captured by the camera 39 in FIGS. 8A-8D show various ways of holding, the controller 24 can still appropriately determine that the operation by the operator 100 is the intentional operation.

Figure 9:
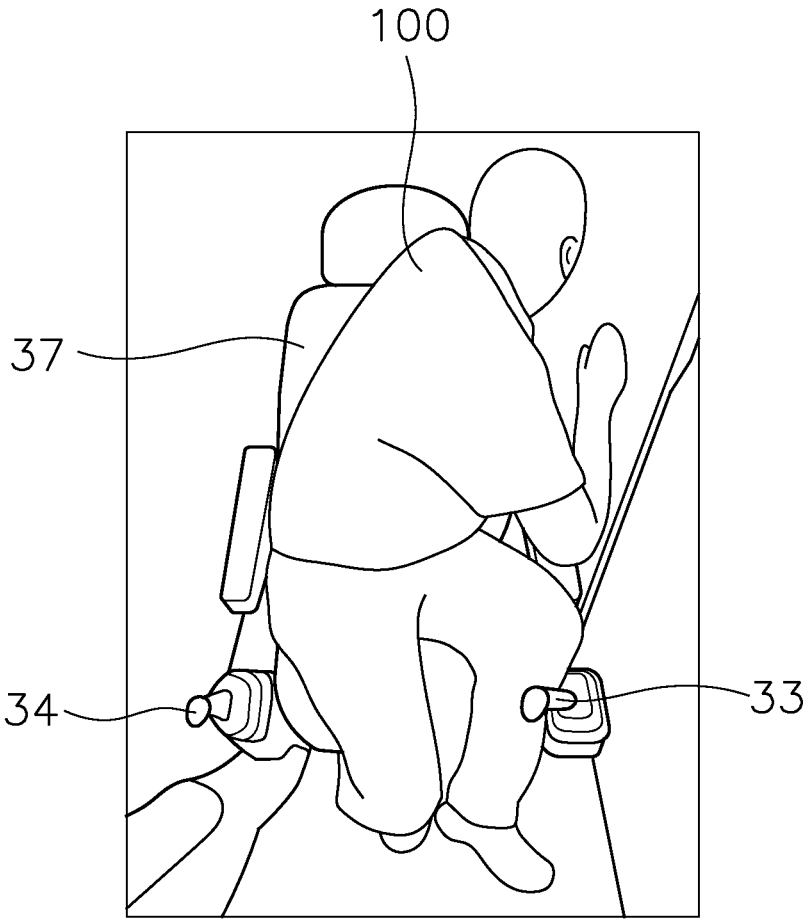
FIG. 9 is a view illustrating an example of an image of the operating state in which the first operating member is touched by a leg of the operator.
Figure 10:
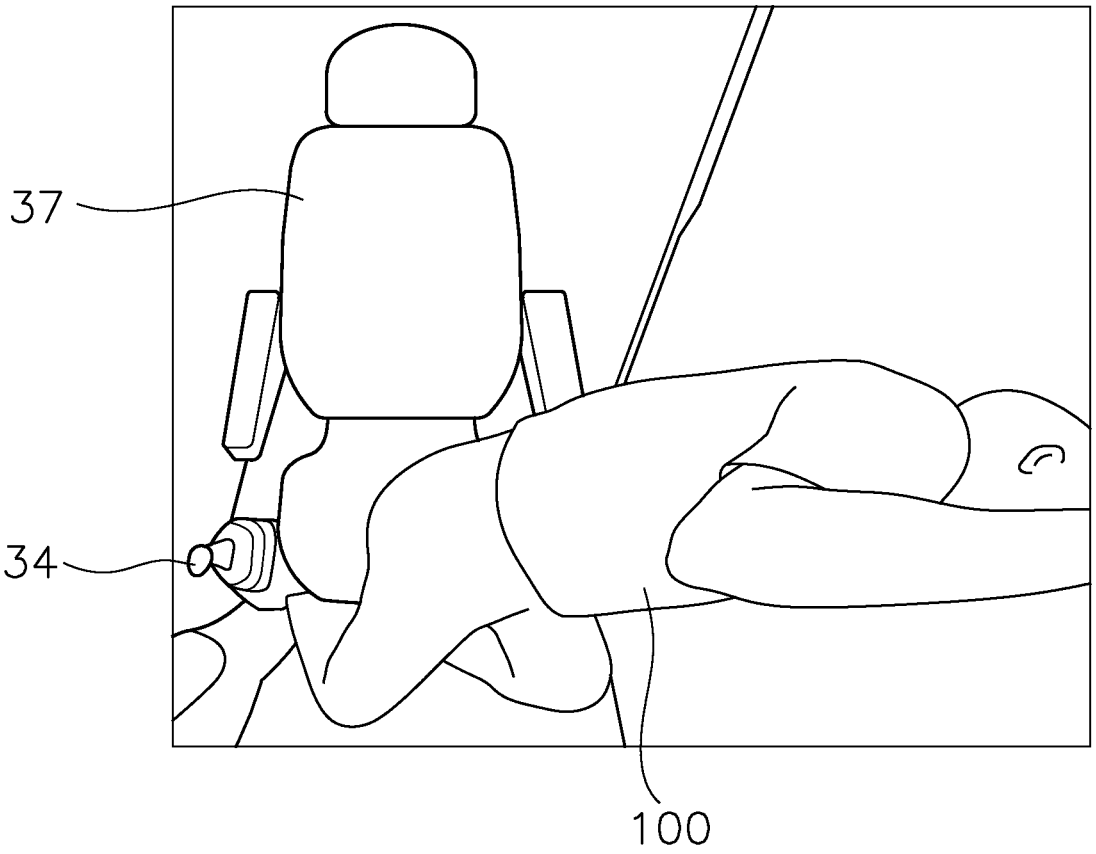
FIG. 10 is a view illustrating an example of an image of the operating state in which the first operating member is touched by a body of the operator.
Figure 11:
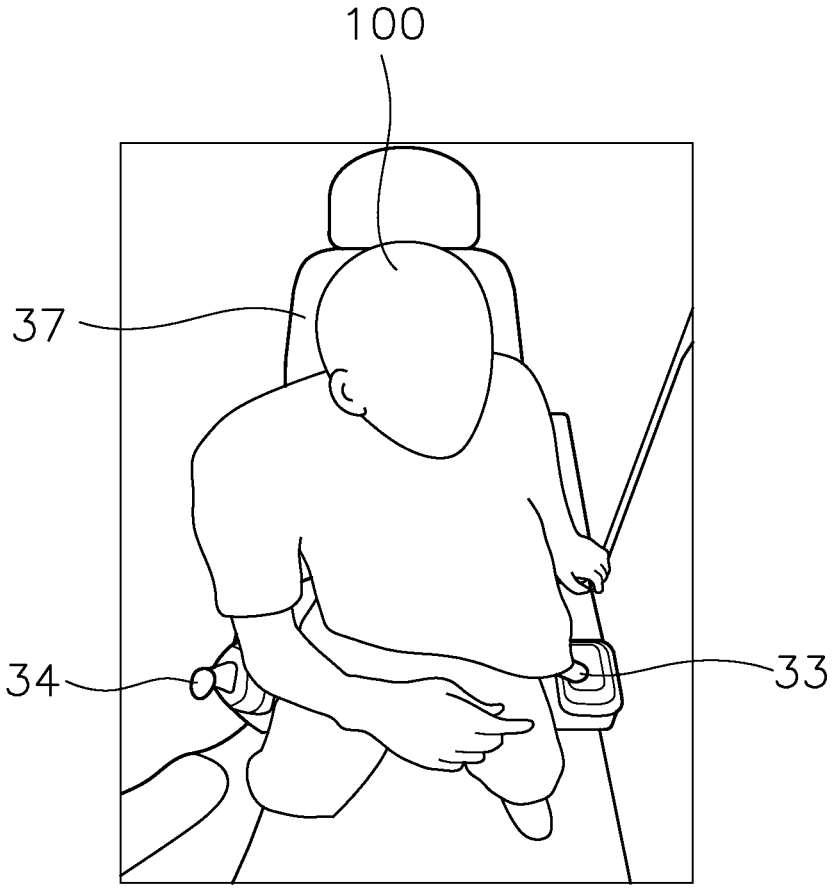
FIG. 11 is a view illustrating an example of an image of the operating state in which the first operating member is touched by clothing of the operator.

On the other hand, for the image showing that the operating member is touched by a portion other than the hand of the operator 100 as illustrated in FIGS. 9 to 11, the image recognition model 41 is trained to output the output data D12 indicative of the unintentional operation. Therefore, when the image captured by the camera 39 shows that the operating member is touched by a portion other than the hand of the operator 100, the image recognition model 41 outputs the output data D12 indicative of the unintentional operation. In this case, the controller 24 determines that the operation by the operator 100 is the unintentional operation.

For example, for the image showing that the first operating member 33 is touched by a foot of the operator 100 as illustrated in FIG. 9, the image recognition model 41 is trained to output the output data D12 indicative of the unintentional operation. For the image showing that the first operating member 33 is touched by a body of the operator 100 as illustrated in FIG. 10, the image recognition model 41 is trained to output the output data D12 indicative of the unintentional operation. For the image showing that a portion of clothes of the operator 100 is caught on the first operating member 33 as illustrated in FIG. 11, the image recognition model 41 is trained to output the output data D12 indicative of the unintentional operation. Therefore, when the image captured by the camera 39 shows that the operating member is touched by a portion other than the hand of the operator 100, the controller 24 can appropriately determine that the operation by the operator 100 is the unintentional operation.

When it is determined in step S104 that the operation by the operator 100 is the intentional operation, the process proceeds to step S105. In step S105, the controller 24 allows the operation of the first operating member 33. That is, the controller 24 causes the work implement 3 or the rotating body 4 to operate according to the operation of the first operating member 33.

When it is determined in step S104 that the operation by the operator 100 is the unintentional operation, the process proceeds to step S106. In step S106, the controller 24 maintains the lock. That is, the controller 24 invalidates the operation of the first operating member 33 and does not cause the work implement 3 or the rotating body 4 to operate regardless of the operation of the first operating member 33.

According to the control system of the work machine 1 according to the present embodiment described above, it is determined whether the operation of the first operating member 33 by the operator 100 is the intentional operation or the unintentional operation based on the image of the region including at least a portion of the first operating member 33. Therefore, it is possible to detect an erroneous operation with high accuracy regardless of a way of operating the first operating member 33 by the operator 100. Further, it is possible to quickly determine whether the operation of the first operating member 33 by the operator 100 is a normal operation. Therefore, the deterioration of the operability of the work machine 1 during normal operation can be reduced. The same effect as described above can be achieved in a case where the second operating member 34 is operated.

Although an embodiment of the present invention has been described so far, the present invention is not limited to the above embodiment and various modifications can be made without departing from the gist of the invention.

The work machine 1 is not limited to the hydraulic excavator and may be another type of work machine, such as a wheel loader, a bulldozer, or a motor grader. The configuration of the work machine 1 is not limited to that as mentioned above and may be changed. For example, the rotation motor 25 may be an electric motor.

The first to fourth operating members 33 to 36 are not limited to those of the above embodiment and may be modified. For example, the first to fourth operating members 33 to 36 are not limited to levers and may be switches. A portion of the first to fourth operating members 33 to 36 may be omitted or changed. Alternatively, another operating member, such as a steering wheel, may be provided. The controller 24 may execute the same processes for detecting an erroneous operation on the steering wheel as described above. The work machine 1 may include a steering mechanism. The controller 24 may steer the work machine 1 according to the operation of the operating member by the operator.

The field of view of the camera 39 may include only one of the first operating member 33 or the second operating member 34. The field of view of the camera 39 may not include the seat 37. A camera may be provided individually for each of the first operating member 33 and the second operating member 34. The field of view of the camera 39 may include the third operating member 35 or the fourth operating member 36. The controller 24 may execute the same processes for detecting an erroneous operation on the third operating member 35 or the fourth operating member 36 as described above.

The controller 24 may include a plurality of processors, such as a CPU or a GPU. The above processes may be distributed and executed among the plurality of processors 31. The controller 24 is not limited to one unit and the above processes may be distributed and executed among the plurality of controllers. For example, FIG. 12 is a diagram illustrating the control system of the work machine 1 according to a modified example.

Figure 12:
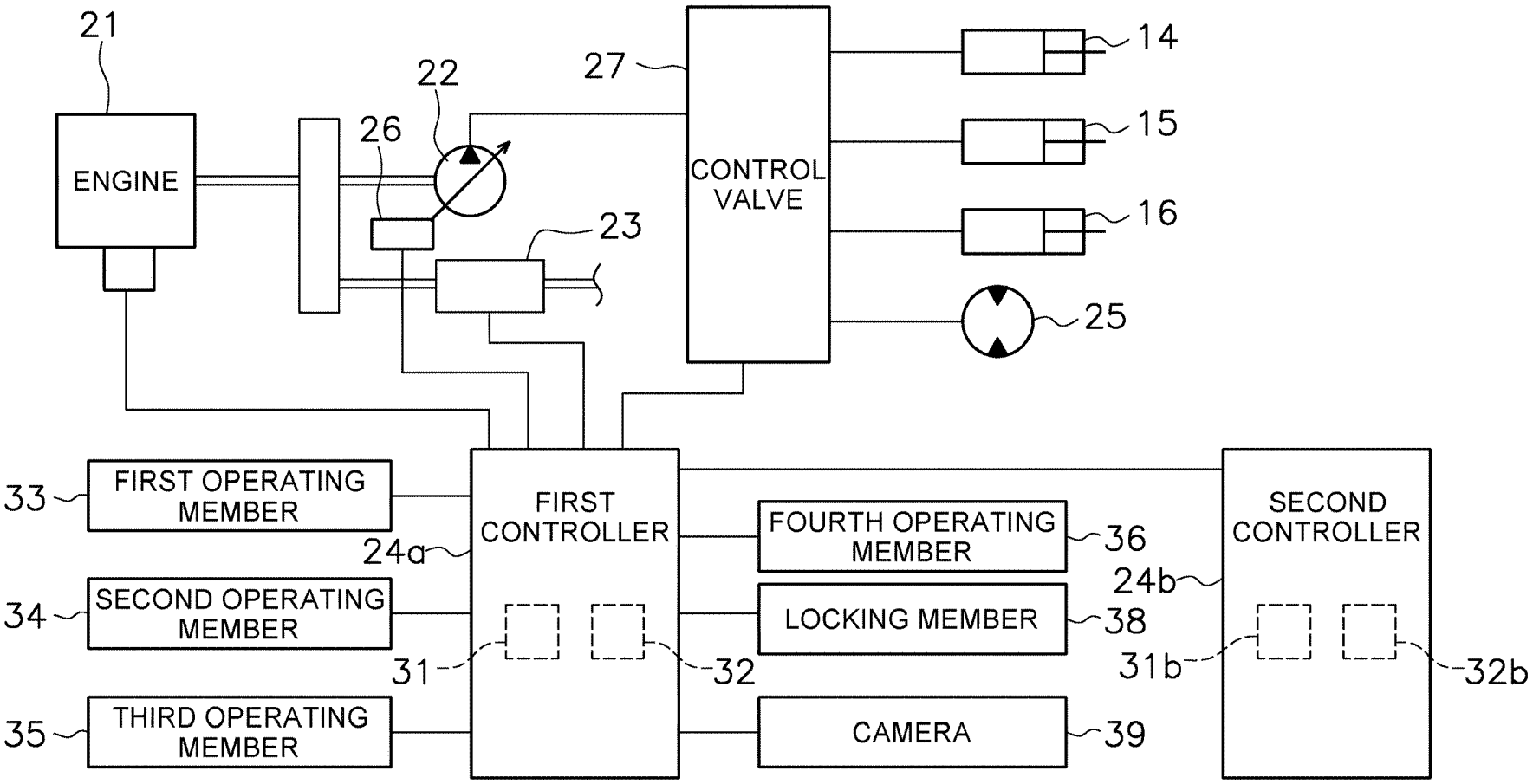
FIG. 12 is a block diagram illustrating a configuration of the control system of the work machine according to a modified example.

As illustrated in FIG. 12, the control system of the work machine 1 may include a first controller 24*a* and a second controller 24*b*. The first controller 24*a* has the same configuration as the controller 24 of the above embodiment. The second controller 24*b* includes a processor 31*b* and a storage device 32*b* in the same manner as the first controller 24*a*. The second controller 24 may have a processing capacity suitable for the image recognition using AI. Among the above-mentioned processes, the processes for determining the operation with the image recognition may be executed by the second controller 24*b*. The first controller 24*a* may execute processes for controlling the work machine 1 such as outputting the command signals to the control valve 27.

The order of the above-mentioned processes may be changed. Some of the above-mentioned processes may be changed or omitted. For example, the determination between the intentional operation and the unintentional operation may be performed by another image recognition technology using AI such as a support vector machine, instead of deep learning. Alternatively, the determination between the intentional operation and the unintentional operation is not limited to AI and may be performed by a rule-based image recognition technology such as pattern matching.

Figure 13:
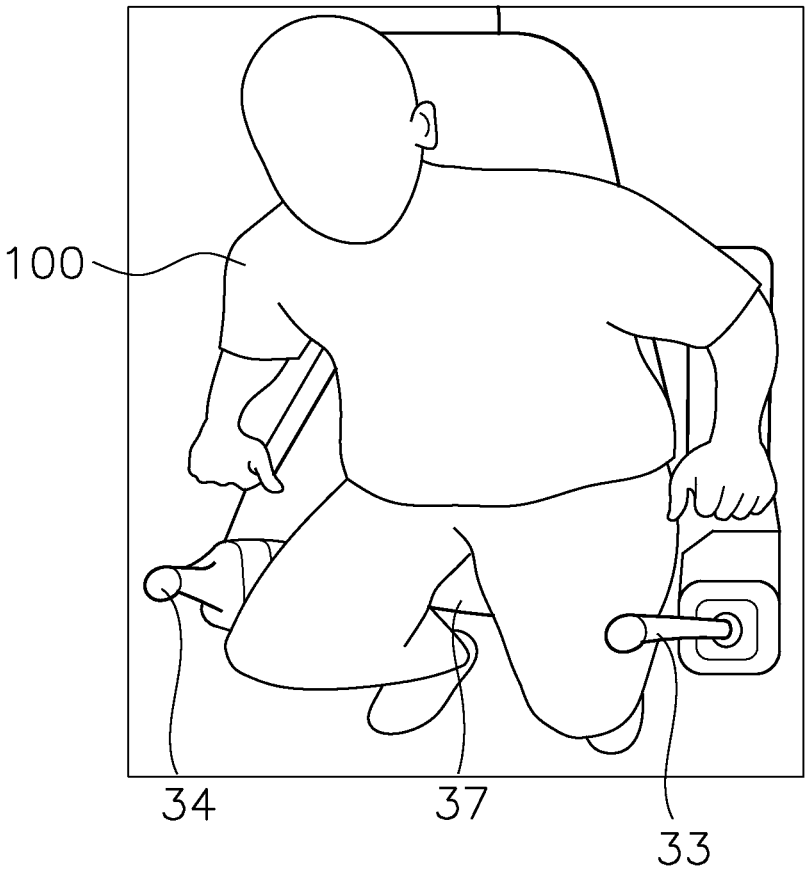
FIG. 13 is a view illustrating an example of an image of the operating state in which the first operating member is operated by hand.

As illustrated in FIG. 13, the controller 24 may determine that the operation of the operator 100 is the intentional operation when the operator 100 is trying to hold the first operating member 33 by the hand. Accordingly, the operability of the work machine 1 can be further improved.

Figure 14:
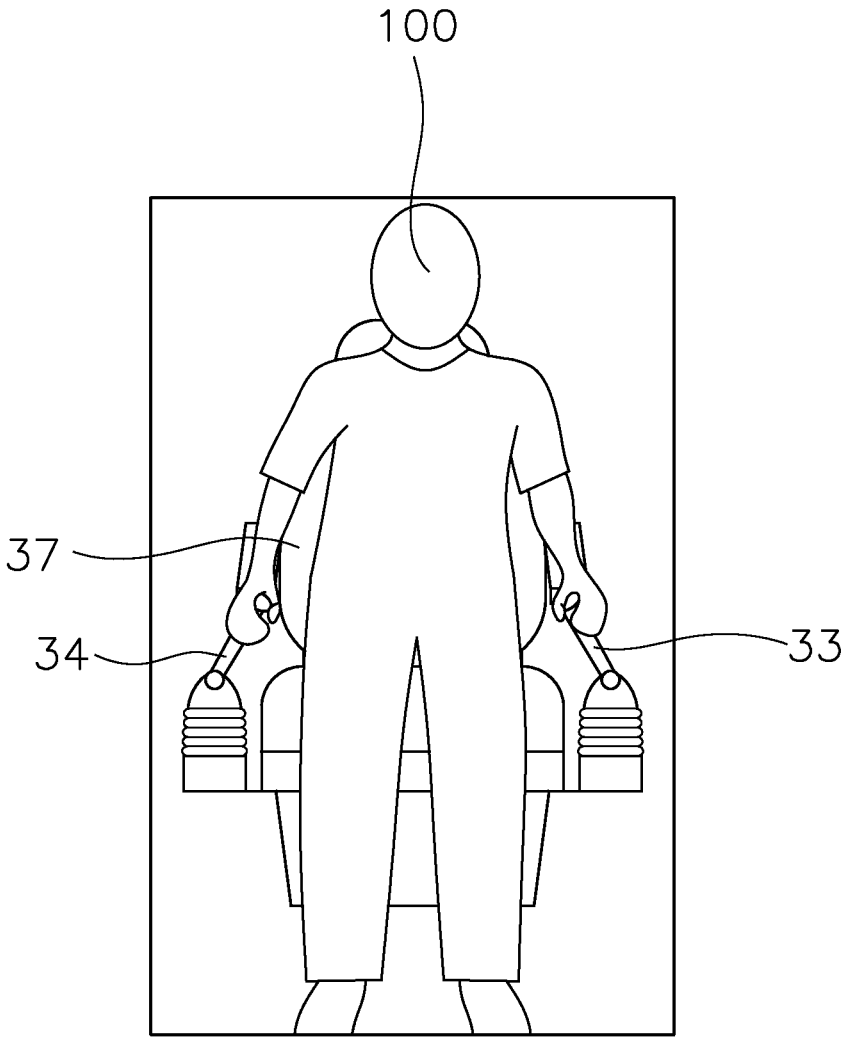
FIG. 14 is a view illustrating an example of an image of the operating state in which the first operating member is operated by the operator while standing.

As illustrated in FIG. 14, when the image captured by the camera 39 shows that the operator 100 holds the first operating member 33 while standing, the controller 24 may determine that the operation by the operator 100 is the intentional operation. For example, the operator 100 may operate the first operating member 33 while standing in order to confirm the surrounding conditions of the work machine 1. Therefore, the controller 24 can appropriately determine that the operation of the operator as illustrated in FIG. 13 is the intentional operation.

Figure 15:
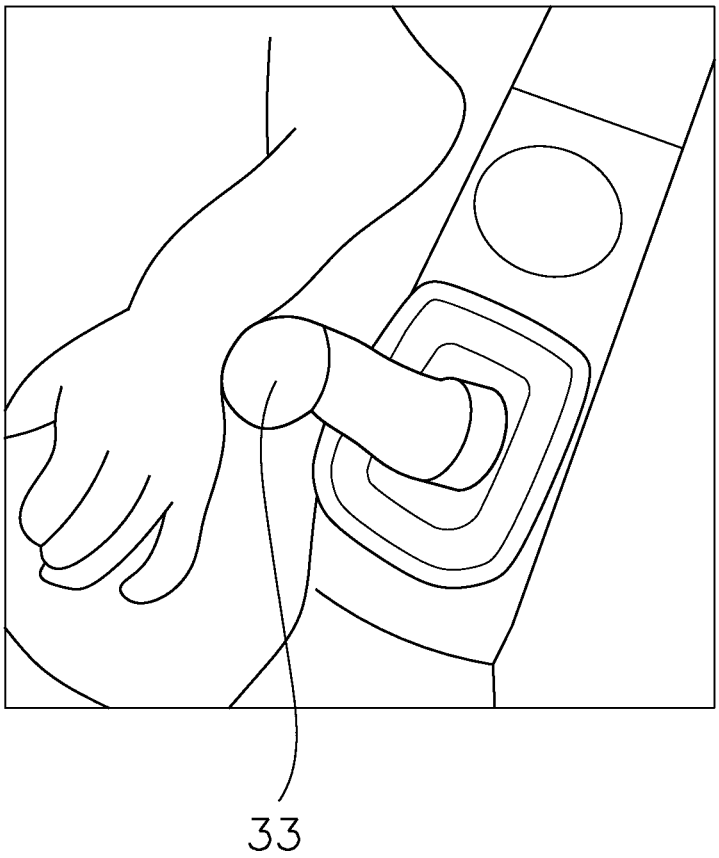
FIG. 15 is a view illustrating an example of an image of the operating state in which the first operating member is touched by an arm of the operator.
Figure 16:
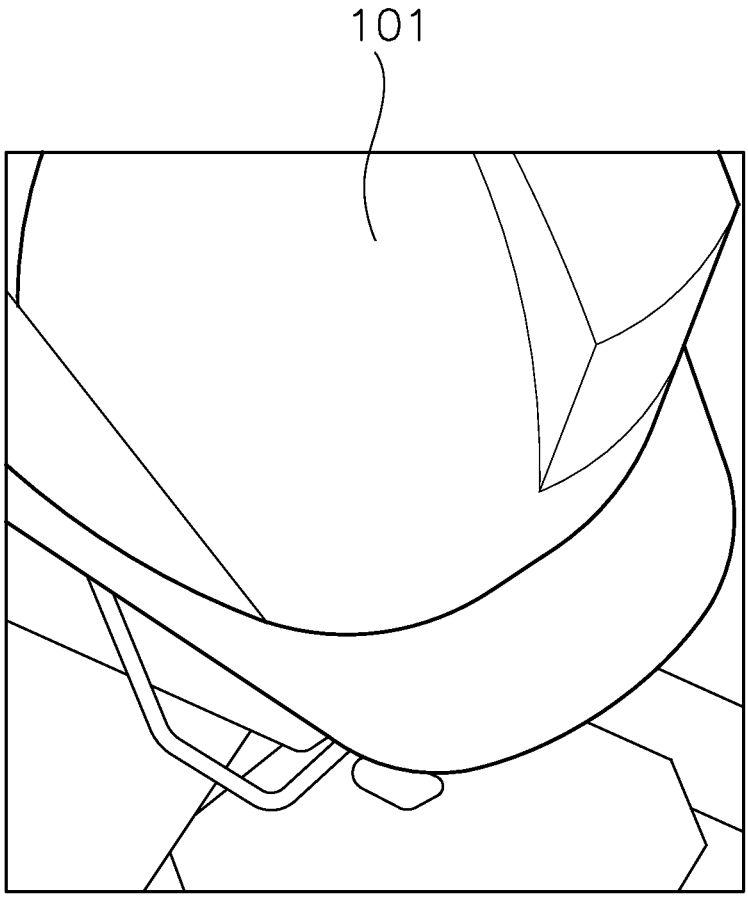
FIG. 16 is a view illustrating an example of an image of the operating state in which the first operating member is not visible in an image captured by a camera.

As illustrated in FIG. 15, when the first operating member 33 is not held by a hand of the operator 100 and is touched by an arm, the controller 24 may determine that the operation of the operator 100 is the unintentional operation. As illustrated in FIG. 16, when the operating member does not appear in the image because it is hidden by a wearable object 101 of the operator 100, such as a helmet, the controller 24 may determine that the determination is impossible. Alternatively, when the operating member does not appear in the image because it is hidden by the body of the operator 100, the controller 24 may determine that the determination is impossible. In this case, the controller 24 may maintain the lock.

According to the present disclosure, it is possible to detect an erroneous operation of the work machine with high accuracy.

The invention claimed is:

1. A system for preventing an erroneous operation of a work machine, the system comprising:

an operating member configured to be operated by an operator;

a camera arranged such that a field of view of the camera includes at least a portion of the operating member and configured to capture an image of an operation of the operating member by the operator; and a controller configured to acquire the image from the camera, the controller being configured to determine whether the operation of the operating member by the operator is an intentional operation or an unintentional operation based on the image, control the work machine according to the operation of the operating member when the operation of the operating member by the operator is determined to be the intentional operation, and invalidate the operation of the operating member when the operation of the operating member by the operator is determined to be the unintentional operation.

2. The system according to claim 1, wherein the operating member is configured to be operated by a hand of the operator, and the controller is configured to determine that the operation of the operating member by the operator is the intentional operation when the image shows that the operating member is held by the hand of the operator.

3. The system according to claim 2, wherein the controller is configured to determine that the operation of the operating member by the operator is the unintentional operation when the image shows that the operating member is touched by a portion other than the hand of the operator.

4. The system according to claim 2, wherein the controller is configured to determine that the operation of the operating member by the operator is the unintentional operation when the image shows that a portion of clothes of the operator is caught on the operating member.

5. The system according to claim 2, wherein the operating member is a lever.

6. The system according to claim 2, wherein the operating member is a steering wheel.

7. The system according to claim 1, wherein the controller includes a trained image recognition model of artificial intelligence, and is configured to apply the image to the image recognition model to determine whether the operation of the operating member by the operator is the intentional operation or the unintentional operation.

8. The system according to claim 1, wherein the work machine is an excavator.

9. A control method of a work machine for preventing an erroneous operation of the work machine that includes an operating member, the control method comprising:

acquiring an image from a camera that is arranged such that a field of view of the camera includes at least a portion of the operating member and configured to capture an operation of the operating member by an operator;

determining whether the operation of the operating member by the operator is an intentional operation or an unintentional operation based on the image;

controlling the work machine according to the operation of the operating member when the operation of the operating member by the operator is determined to be the intentional operation; and invalidating the operation of the operating member when the operation of the operating member by the operator is determined to be the unintentional operation.

10. The control method according to claim 9, wherein the operating member is configured to be operated by a hand of the operator, the control method further comprising:

determining that the operation of the operating member by the operator is the intentional operation when the image shows that the operating member is held by the hand of the operator.

11. The control method according to claim 10, further comprising:

determining that the operation of the operating member by the operator is the unintentional operation when the image shows that the operating member is touched by a portion other than the hand of the operator.

12. The control method according to claim 10, further comprising:

determining that the operation of the operating member by the operator is the unintentional operation when the image shows that a portion of clothes of the operator is caught on the operating member.

13. The control method according to claim 10, wherein the operating member is a lever.

14. The control method according to claim 10, wherein the operating member is a steering wheel.

15. The control method according to claim 9, further comprising:

applying the image to a trained image recognition model of artificial intelligence to determine whether the operation of the operating member by the operator is the intentional operation or the unintentional operation.

16. The control method according to claim 9, wherein the work machine is an excavator.

17. An excavator comprising:

a traveling body;

a rotating body rotatably attached to the traveling body;

a work implement attached to the rotating body;

a cab disposed on the rotating body;

an operating member disposed in the cab and configured to be operated by an operator to operate at least one of the traveling body, the rotating body, or the work implement;

a camera arranged such that a field of view of the camera includes at least a portion of the operating member and configured to capture an image of an operation of the operating member by the operator; and a controller configured to acquire the image from the camera, the controller being configured to determine whether the operation of the operating member by the operator is an intentional operation or an unintentional operation based on the image, control at least one operation of the traveling body, the rotating body, or the work implement according to the operation of the operating member when the operation of the operating member by the operator is determined to be the intentional operation, and invalidate the operation of the operating member when the operation of the operating member by the operator is determined to be the unintentional operation.

* * * * *